United States Patent [19]

Wales

[11] Patent Number: 4,969,850

[45] Date of Patent: Nov. 13, 1990

[54] METHOD OF MANUFACTURING A COLD CATHODE, FIELD EMISSION DEVICE AND A FIELD EMISSION DEVICE MANUFACTURED BY THE METHOD

[75] Inventor: James L. S. Wales, Caversham, England

[73] Assignee: Thorn EMI plc, London, England

[21] Appl. No.: 379,231

[22] Filed: Jul. 13, 1989

[30] Foreign Application Priority Data

Jul. 13, 1988 [GB] United Kingdom ..... 8816689

[51] Int. Cl.[5] ..... H01J 9/02; H01J 19/24

[52] U.S. Cl. ..... 445/50; 313/309; 445/51

[58] Field of Search ..... 445/45, 50, 51; 313/309

[56] References Cited

U.S. PATENT DOCUMENTS

| | | | |
|---|---|---|---|
| 3,466,485 | 9/1969 | Arthur et al. | 313/309 X |
| 3,671,798 | 6/1972 | Lees | 313/309 X |
| 3,745,402 | 7/1973 | Shelton et al. | 313/309 X |
| 3,746,905 | 7/1973 | Shelton et al. | 313/309 |
| 3,783,325 | 1/1974 | Shelton | 445/51 |
| 3,982,147 | 9/1976 | Redman | 313/309 |
| 4,163,918 | 8/1979 | Shelton | 313/309 |

*Primary Examiner*—Kenneth J. Ramsey

*Attorney, Agent, or Firm*—Fleit, Jacobson, Cohn, Price, Holman & Stern

[57] ABSTRACT

A method is provided for manufacturing a cold cathode field emission device. The method comprises the steps of:

providing a layer of anodised alumina having a plurality of elongate pores which are substantially orthogonal to major surfaces of the layer;

filling said pores completely with an electron emission material, and then removing at least a part of said layer to form a defined surface of said layer and to produce a plurality of electron emissive spikes extruding from and at an angle to said defined surface wherein a plurality of electron emissive structures are produced, each structure comprising a plurality of electron emissive spikes inclined to one another.

12 Claims, 7 Drawing Sheets

METHOD OF MANUFACTURING A COLD CATHODE, FIELD EMISSION DEVICE AND A FIELD EMISSION DEVICE MANUFACTURED BY THE METHOD

This invention relates to a method of manufacturing a cold cathode, field emission device and to a field emission device manufactured by the method.

U.S. Pat. No. 4,307,507 (Gray et al) discloses a field emission device which is manufactured by depositing an electron emissive material on a surface of a single crystal material which has been etched crystallographically in order to create an array of pits. The single crystal material is then removed by etching to leave a field emission device having a plurality of sharp, field emissive spikes.

This, and other known techniques (involving spontaneously grown whiskers or metal eutectics, for example) are both time consuming and costly.

U.S. Pat. No. 4,591,717 (Scherber) for example discloses a photo-electric field emission device for a photoelectric detector. The photosensitive layer comprises a plurality of densely packed metal, electrically conductive needles arranged in vertical alignment on a substrate. An oxide layer is deposited by anodie oxidation on a substrate, the layer having vertically oriented pores and metallic whiskers are grown in the pores so as to extend beyond the oxide layer.

It is an object of the present invention to provide an alternative method for manufacturing a cold cathode, field emission device.

According to one aspect of the invention there is provided a method of manufacturing a cold cathode, field emission device, the method comprising the steps of:

providing a layer of anodised alumina having a plurality of elongate pores which are substantially orthogonal to major suefaces of the layer;

filling said pores completely with an electron emissive material; and then removing at leat a part of said layer to form a defined surface of said layer and to produce a plurality of electron emissive spikes extending from and at an angle to said defined surface wherein a plurality of electron emissive structures are produced, each structure comprising a plurality of electron emissive spikes inclined to one another.

An anodised alumina structure, suitable for use in the method of the present invention, is available commercially, albeit for an entirely different application, and so the present invention can provide a convenient, low cost alternative to existing methods of manufacture.

The method in accordance with the invention has the further advantage that a plurality of electron emissive structures are produced, each structure comprising a plurality of electron emissive spikes inclined to one another. Compared with prior art field effect electron emission devices produced from anodised metal oxides, in which the separation of the electron emissive spikes is substantially equal to the separation of the pores, the present invention provides a device in which the separation between individual electron emissive structures is greater than the separation of the pores. Accordingly, the ratio of radius of tip of electron emissive structure to separation of electron emissive structures is reduced by the method of the present invention with enhanced effect of field electron emission.

Prior to the step of retaining at least a part of said layer, a surface of said layer may be abraded to produce a smooth finish, thus providing electron emissive spikes of the same length. Alternatively, or in addition, a grooved finish may be produced to improve the sharpness of the electron emissive structures.

Said electron emissive material may be an electroplateable metal, or a mixture of electroplateable metals or an alloy of electroplateable metals and may be selected from the group cobalt, nickel, tin, tungsten, silver, tellurium, selenium, manganese, zinc, cadmium, lead, chromium and iron.

Said layer of anodised alumina may be provided on a layer of aluminium, there being a continuous barrier layer of anodised alumina between said pores and said layer of aluminium.

Said step of removing at least a part of said layer may consist in removing all the anodised alumina, except that which constitutes the continuous barrier layer.

In another embodiment the method includes, prior to said step of removing at least a part of said layer, the additional step of providing, at an exposed surface of said layer of anodised alumina, a continuous layer of said electron emissive material, and said step of removing at least a part of said layer also includes removal of both said layer of aluminium and said continuous barrier layer.

According to another aspect of the invention there is provided a cold cathode, field emission device whenever manufactured by the method according to said first aspect of the invention.

In order that the invention may be carried readily into effect embodiments thereof are now described, by way of example only, by reference to the accompanying drawings of which, FIG. 1 illustrate schematically a cross-sectional view through a part of a field emission device;

FIGS. 2*a* and 2*b* show respectively a cross-sectional view and a SEM micrograph of a field emission device provided in accordance with the present invention;

Figure 1:
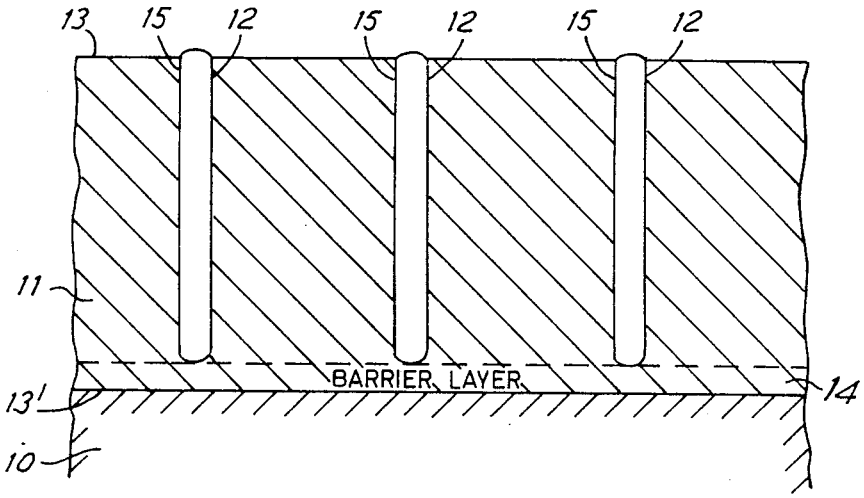
Figure 8:
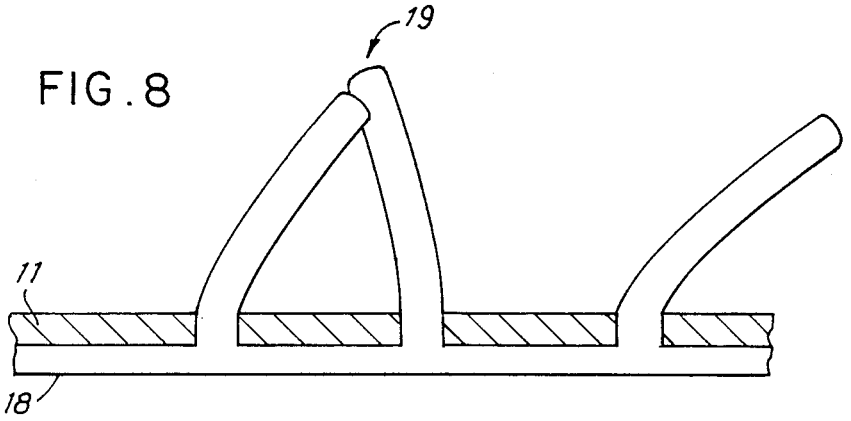
Figure 7A:
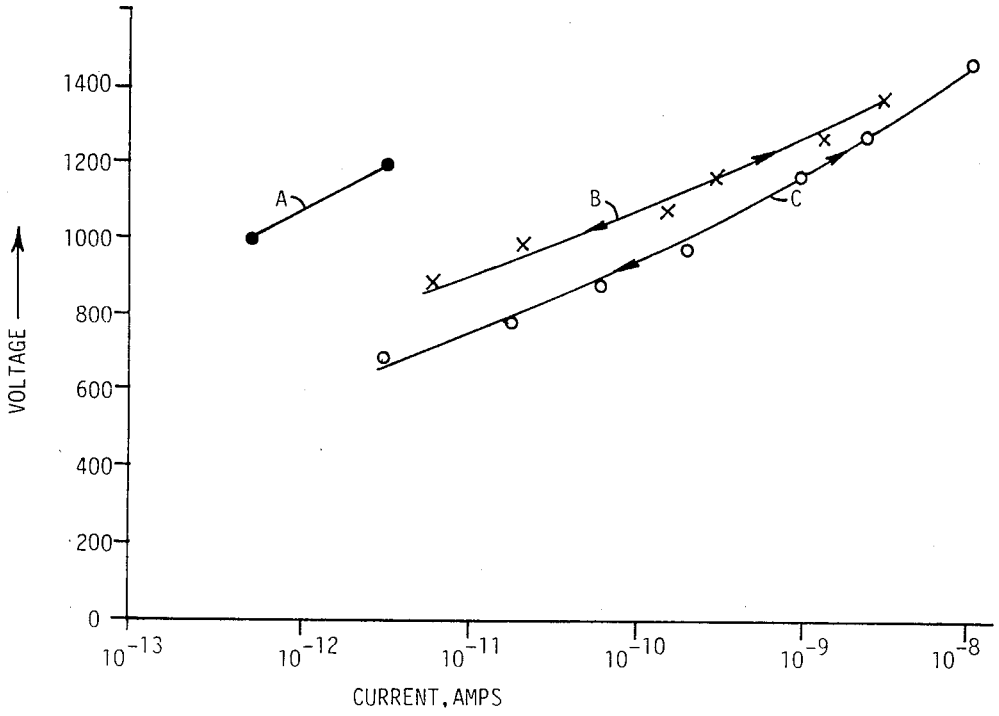
Figure 7B:
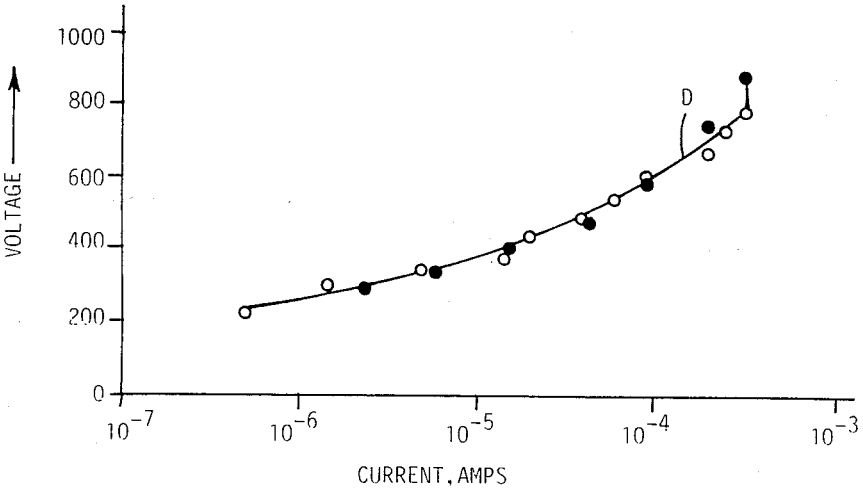

FIG. 7*a* and 7*b* compare the current voltage relationship obtained using the field emission devices of FIGS. 1 and 2; and FIG. 8 shows another field emission device in accordance with the present invention.

The field emission device shown in FIG. 1 of the drawings comprises a layer 10 of aluminium bearing a layer 11 of anodised alumina ($Al_2O_3$); that is, a layer of alumina formed by the anodisation of aluminium. Layer 11, which is typically 15 microns thick, has a plurality of elongate substantially cylindrical pores (e.g. 12) which develop naturally during the anodising procedure, and are aligned substantially orthogonally with respect to major surfaces (13, 13') of the layer. The pores extend to one only of the major surfaces, there being a continuous barrier layer 14 of anodised alumina between the pores and layer 10, and are filled completely with a suitable electron emissive material such as cobalt, though, alternatively other electron emissive materials such as nickel, tin, tungsten, and other electroplateable materials (e.g. silver, tellurium, selenium, manganese, zinc, cadmium, lead and chromium) or mixtures or alloys of two or more of these materials could be used. The resulting structure provides an array of columnar electron emissive elements 15 each typically 10–100 nm in diameter, and about 15 μm long with neighbouring elements spaced apart from one another by about 50–150 nm.

A structure similar to that shown in FIG. 1 can be obtained commercially. However, unlike the structure shown in FIG. 1, commercially available structures have irregularly filled pores, some of the pores being only partially filled. It may be desirable, therefore, to deposit additional electron emissive material thereby to ensure that each pore is filled completely. Layer 11 may then be mechanically abraded using fine grain emery paper in order to remove any excess electron emissive material, to create a smooth, flat surface finish, and to provide electron emissive elements 15 which are of substantially equal lengths.

The commercially available structures have been used hitherto for decorative purposes, as metallic coatings on facia panels, trims and the like. However, to the inventor's knowledge it has never been proposed to use a structure of that kind in the manufacture of an electron emission device.

It will be appreciated that, alternatively, the manufacture of layers 10 and 11, and or deposition of the electron emissive material, could be carried out "in house". Typically the electron emissive material would be deposited by electroplating or electrophoresis.

In theory, the effect of field emission for a device having a plurality of emitters is expected to depend on the tip radius R of each emitter, the separation between emitters a and the anode to cathode separation L. An acceptable restriction is $4\pi RL \leqq a^2$. Thus for a tip radius R of about 25 nm, and anode to cathode separation L of from 200 μm to 4 mm, the minimum emitter separation should be in the range of from about 10 μm to about 30 μm.

Figure 2A:
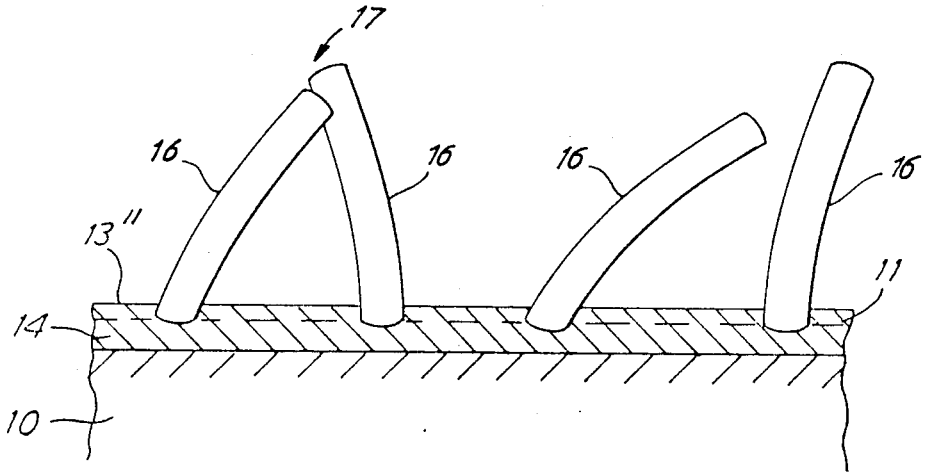
Figure 2B:
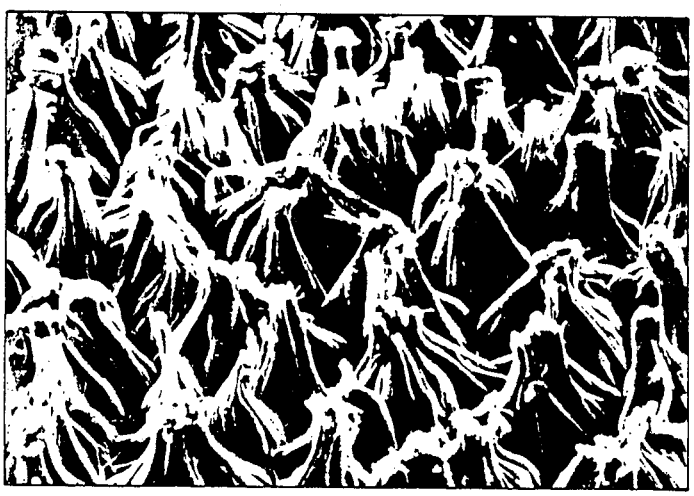

The inventor has found that it is possible to produce an improved field emission device by etching back part of the layer 11 to form a defined surface 13". As the layer 11 is etched back, the elements 15 tend to collapse producing spikes 16 inclined relative to the outward surface 13" of the layer 11 and to one another, so forming structure 17. FIG. 2*a* shows a field emission device wherein all but a residual part of layer 11 has been removed by etching and FIG. 2*b* shows a SEM micrograph of the resulting structure.

The optimum processing conditions required for producing structures 16 is dependent on a number of parameters. In one example, a device similar to that of FIG. 1, but with an anodic layer of thickness about 23 μm containing cobalt filled pores was etched with a solution of 20% NaOH (caustic soda solution). Etching for 0.5 minutes produced irregular pointed structures about 2 to 3 μm apart. A one minute etch produced the wigwam-like structures of FIG. 2*b*, the tips of the structures having a separation of about 10 μm. Etching for about 1.5 minutes led to a collapsed and flattened wigwam-like structure with tips of separation up to 40 μm. Further etching degraded the form of the device: 2 minutes etching produced a honeycomb-like form with fibrous walls and cells of 5 to 10 μm; 3 minutes etching produced a form in which bare aluminium showed between tufts of fibres of the electron emissive material.

The etching parameters required are related to the length of spikes 16 which will lead to the wigwam-like structures 17. The inventor has found that, for electron emissive spikes produced by electroplating using sulphuric acid and a potential difference of 18 V, wigwam-like structures can be produced from spikes of length in the range of from 5 μm to 15 μm.

The barrier layer 14, which is shown in FIGS. 1 and 2*a* and is normally less than 20 nm thick, is not completely electrically insulating and so, at most practical voltages, electrons are able to tunnel through the barrier layer. It is believed that layer 14 is beneficial in that it imposes a degree of current limitation on the device and also promotes even distribution of current amongst the individual electron emissive elements 16.

Figure 3:
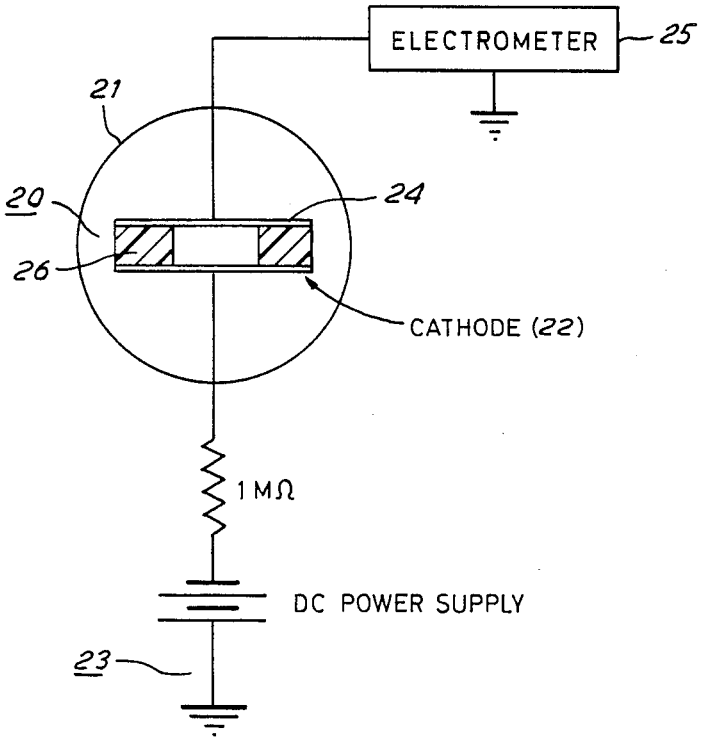
FIG. 3 illustrates, diagrammatically, an electron tube apparatus incorporating a field emission device.

FIG. 3 illustrates an electron tube apparatus which has been used to evaluate the operational performance of a field emission device in accordance with the present invention. The apparatus comprises a cathode-anode pair 20 mounted within a vacuum chamber 21, the cathode 22 of pair 20 being coupled to a source 23 of DC voltage and the anode 24 of the pair being coupled to a current measuring device 25, in this case a Keithley 610c electrometer.

Figure 4:
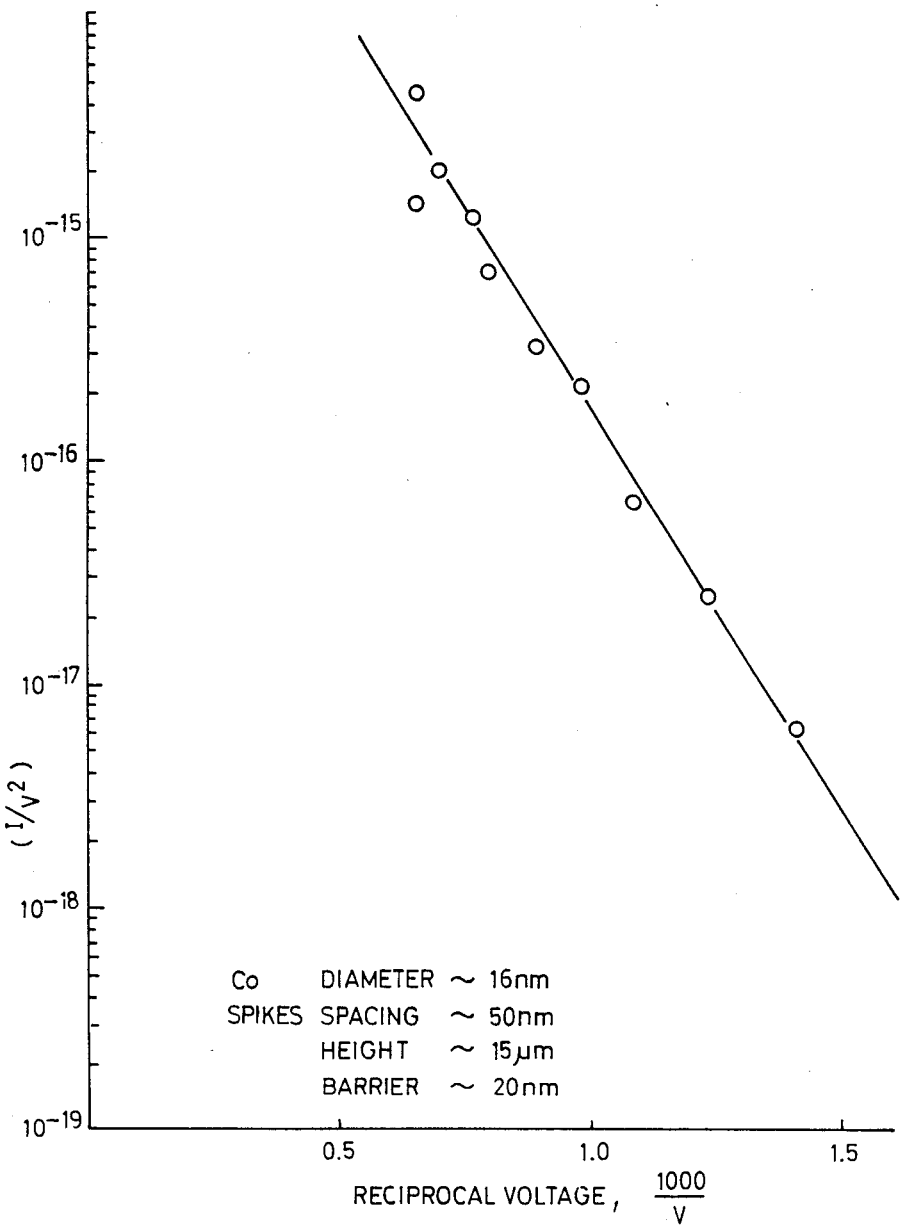
FIG. 4 illustrates the current-voltage relationship (represented as a Fowler-Nordheim plot) obtained using the field emission device of FIG. 1.

The cathode comprises a field emission device and the anode, a resilient skid made of molybdenum strip, is spaced apart from the electron emissive surface of the cathode by means of a polyester film 26, 12 μm thick. The film has a central aperture, 6 mm in diameter, allowing electrons to pass from the cathode to the anode. The cathode-anode pair was initially sputter cleaned for ½ hour at 400 V in an atmosphere of Argon. Measurements of current (I) and voltage (V) could then be made. FIG. 4 illustrates the current voltage relationship obtained using the field emission device of FIG. 1.

Figure 5:
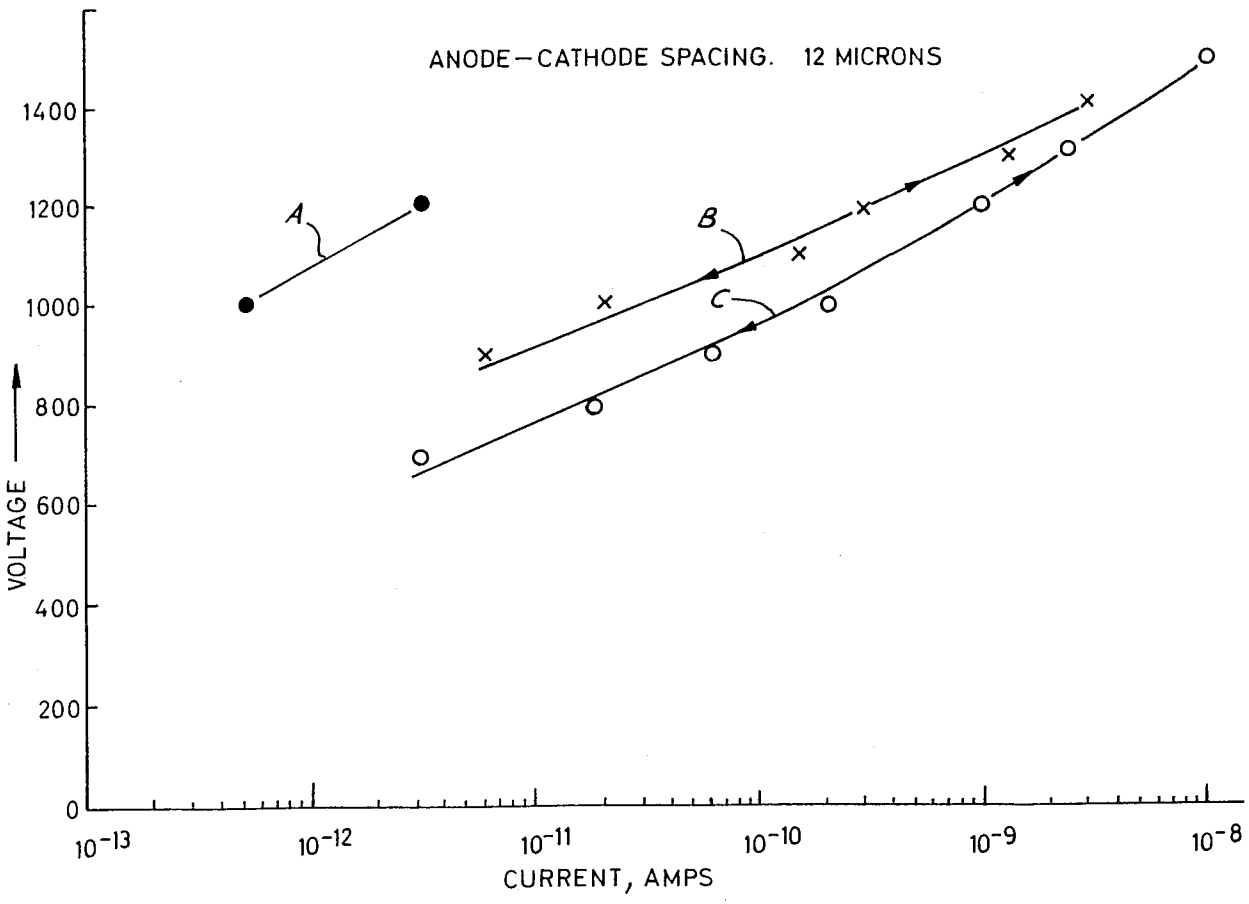
FIG. 5 illustrates current-voltage relationship obtained on successive occasions using the field emission device of FIG. 1.

As described in "Comparison of low voltage field emmissive from TaC and tungsten fibre arrays" by J. K. Cochran, K. J. Lee and D. M. Hill; J. Mater Research 3(1) page 70, 71 January/February, 1988, the current-voltage relation of a field emissive device satisfies the Fowler-Nordheim equation which relates the parameter log ($I/V^2$) almost linearly to the parameter (I/V). As will be apparent from the result presented in FIG. 4, cathode 22 does indeed exhibit the linear relationship characteristic of a field emission device. Moreover, the cathode was found to exhibit a diode action with electrons flowing substantially in one direction only—from the cathode to the anode—there being very little reverse current. The inventor also found that the emission current depends initially upon the history of the applied voltage. Curves, A, B and C in FIG. 5, which represent data gathered on successive occasions, demonstrates that progressively higher emission currents are attained as the maximum applied voltage is increased.

Figure 6:
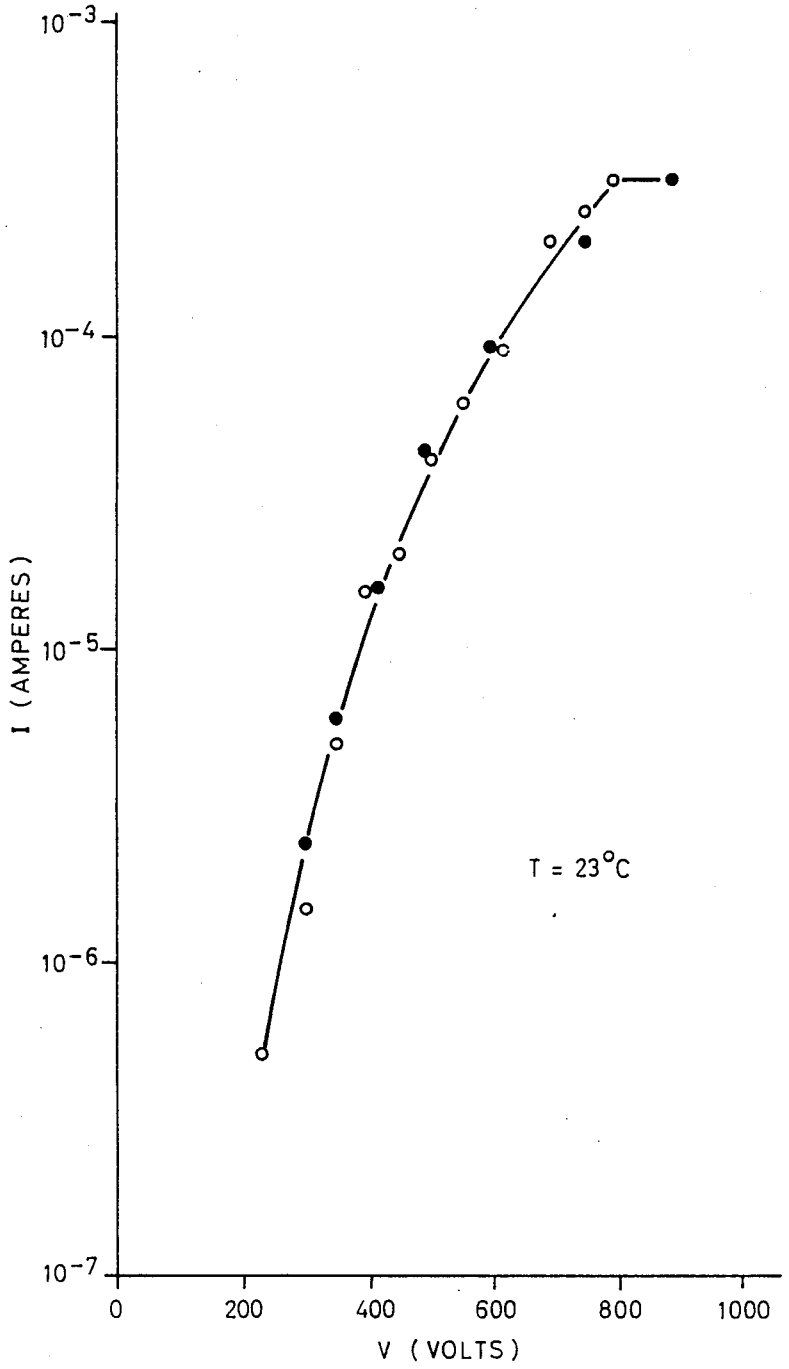
FIG. 6 illustrates a plot of current against voltage obtained using the field emission device of FIG. 2.

FIG. 6 illustrates a plot of current (I) against voltage (V) obtained using the field emission device shown in FIGS. 2, and FIG. 7 compares the results obtained for the field emission devices of FIGS. 1 and 2*a* on the same scale.

As can be seen from FIG. 7, the current which can be achieved by application of a voltage is several orders of magnitude higher for the device of FIG. 2 than for the device of FIG. 1. The inventor believes this to be due to the smaller ratio of radius of tip of electron emissive structure to separation of electron emissive structures which can be achieved by the method of the present invention.

It is envisaged that the sharpness of each electron emissive structure 17 can be increased by producing grooves in the surface of the layer 11 prior to etching, preferably criss-cross grooves.

FIG. 8 illustrates another embodiment in accordance with the present invention. In this case pores 12 have been filled to excess, by electroplating, creating a continuous metallic layer 18, and both the aluminium layer 10 and the layer 11 of anodised alumina (including barrier layer 14) have been removed, again by etching.

If desired, etching may be incomplete so as to leave a residual layer of alumina around, and thereby provide additional support for, the electron emissive structures 19, as shown in FIG. 8.

It will be understood that a field emission device in accordance with the present invention finds application in many other kinds of electron tube apparatus; for example, in an electron microscope or in the electron gun of an instant start television and, in particular, finds application as a cold cathode in the arc tube of a discharge lamp.

I claim:

1. A method of manufacturing a cold cathode, field emission device, the method comprising the steps of:

providing a layer of anodised alumina having a plurality of elongate pores which are substantially orthogonal to major surfaces of the layer;

filling said pores completely with an electron emissive material; and then removing at leat a part of said layer to form a defined surface of said layer and to produce a plurality of electron emissive spikes extending from and at an angle to said defined surface wherein a plurality of electron emissive structures are produced, each structure comprising a plurality of electron emissive spikes inclined to one another.

2. A method according to claim 1 wherein each spike has a length in the range of from 5 μm to 15 μm.

3. A method according to claim 1 including the step of abrading a surface of said layer to produce a substantially flat finish, the abrading step being prior to said step of removing at least a part of said layer.

4. A method according to claim 1 including the step of abrading a surface of said layer to produce a grooved finish, the abrading step being prior to said step of removing at least a part of said layer.

5. A method according to claim 4 wherein said grooved finish is a criss-cross grooved finish.

6. A method according to claim 1 wherein said electron emissive material is an electroplateable metal, a mixture of electroplateable metals or an alloy of electroplateable metals.

7. A method according to claim 6 wherein said electroplateable metal or metals are selected from the group cobalt, nickel, tin, tungsten, silver, tellurium, selenium, manganese, zinc, cadmium, lead, chromium and iron.

8. A method according to claim 1 wherein said layer of anodised alumina is provided on a layer of aluminium, there being a continuous barrier layer of anodised alumina between said pores and said layer of aluminium.

9. A method according to claim 8 wherein said step of removing at least a part of said layer consists in removing all the anodised alumina, except that which constitutes the continuous barrier layer.

10. A method according to claim 8 including, prior to said step of removing at least a part of said layer, the additional step of providing, at an exposed surface of said layer of anodised alumina, a continuous layer of said electron emissive material, and said step of removing at least a part of said layer includes removal of both said layer of aluminium and said continuous barrier layer.

11. A cold cathode field emission device whenever manufactured according to claim 1.

12. An electron tube apparatus incorporating a cold cathode field emission device according to claim 11.

* * * * *